US010352598B2

(12) United States Patent
Szostek et al.

(10) Patent No.: US 10,352,598 B2
(45) Date of Patent: Jul. 16, 2019

(54) HEAT EXCHANGER, IN PARTICULAR A CONDENSER

(71) Applicant: Valeo Autosystemy Sp. z o.o., Skawina (PL)

(72) Inventors: Dawid Szostek, Versailles (FR); Grzegorz Romanski, Kraków (PL); Andrzej Fudala, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 74 days.

(21) Appl. No.: 15/511,067

(22) PCT Filed: Sep. 16, 2015

(86) PCT No.: PCT/EP2015/071264

§ 371 (c)(1),
(2) Date: Mar. 14, 2017

(87) PCT Pub. No.: WO2016/042047

PCT Pub. Date: Mar. 24, 2016

(65) Prior Publication Data

US 2017/0241686 A1 Aug. 24, 2017

(30) Foreign Application Priority Data

Sep. 17, 2014 (EP) ..... 14461568

(51) Int. Cl.
*F28D 9/00* (2006.01)
*F28F 3/02* (2006.01)
(Continued)

(52) U.S. Cl.
CPC ..... *F25B 39/00* (2013.01); *F25B 40/02* (2013.01); *F28D 9/005* (2013.01); *F28F 3/025* (2013.01);
(Continued)

(58) Field of Classification Search
CPC ..... F25B 39/00; F25B 40/02; F25B 39/04; F25B 2339/043; F28D 9/005;
(Continued)

(56) References Cited

U.S. PATENT DOCUMENTS 4,310,960 A * 1/1982 Parker ..... B23P 15/26 165/166
4,373,579 A * 2/1983 Jernqvist ..... F28F 3/083 165/167
(Continued)

FOREIGN PATENT DOCUMENTS

DE 10 2009 050500 A1 4/2011
EP 2 604 953 A1 6/2013
(Continued)

OTHER PUBLICATIONS

International Search Report issued in PCT/EP2015/071264, dated Nov. 19, 2015 (3 pages).
(Continued)

*Primary Examiner* — Justin M Jonaitis
(74) *Attorney, Agent, or Firm* — Osha Liang LLP

(57) ABSTRACT

Heat exchanger, in particular condenser, comprises two parallel end closing plates (1, 2) having made a coolant inlet and outlet and at least one inlet and an outlet of the refrigerant. A heat exchange unit is provided between the closing plates (1, 2) and at least one coolant compartment and at least one refrigerant compartment, separated by an inner plate (5). The coolant compartments and, refrigerant compartments are arranged alternately and connected such that they form together with said inlets and outlets separated hydraulic circuits for the coolant and refrigerant and a turbulator panel (3, 4) is arranged in each of the compartments (3, 4). The turbulator panels (3) of the refrigerant circuit comprise on their surface first disturbing elements (9) the shape of which is matched to the physical properties of
(Continued)

Figure 1:
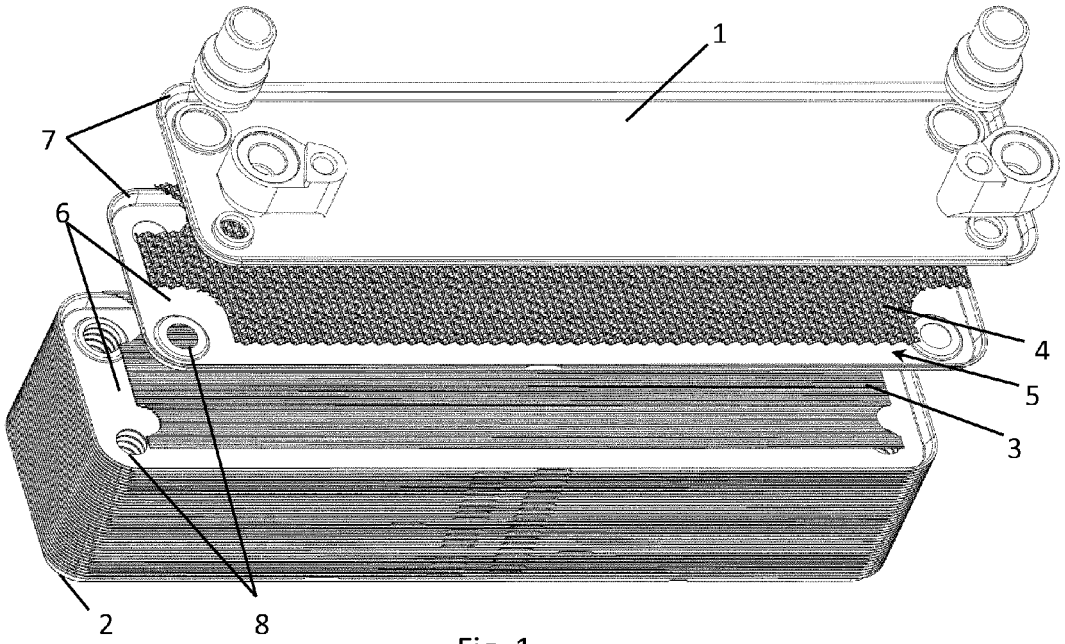

the gaseous refrigerant, and which determine the height of the turbulator panel of the refrigerant circuit, while the turbulator panels (4) of the coolant circuit comprise on their surface second disturbing elements (10) the shape of which is matched to the physical properties of the liquid coolant which determine the height of the turbulator panel of the coolant circuit, wherein the shape of the first disturbing elements (9) is different from the shape of the second disturbing elements (10). The shape of the turbulator panels (3, 4) is matched to the independent optimal managing, slowing down and disturbing of the refrigerant and the coolant, while ensuring a low pressure drop of their flow to achieve a high heat exchange coefficient.

6 Claims, 5 Drawing Sheets

(51) Int. Cl.

| | |
|---|---|
| ***F25B 39/00*** | (2006.01) |
| ***F25B 39/04*** | (2006.01) |
| ***F25B 40/02*** | (2006.01) |
| ***F28D 21/00*** | (2006.01) |
| ***F28F 13/12*** | (2006.01) |

(52) U.S. Cl.
CPC ..... *F28F 3/027* (2013.01); *F28F 13/12* (2013.01); *F25B 39/04* (2013.01); *F25B 2339/043* (2013.01); *F28D 2021/0084* (2013.01); *F28D 2021/0085* (2013.01)

(58) Field of Classification Search
CPC ..... F28D 2021/0084; F28D 2021/0085; F28D 7/00; F28D 9/00; F28F 3/025; F28F 3/027; F28F 13/12; F28F 3/005; F28F 3/08
USPC ..... 165/167, 164, 165, 166
See application file for complete search history.

(56) References Cited

U.S. PATENT DOCUMENTS

| | | | | |
|---|---|---|---|---|
| 4,653,581 | A * | 3/1987 | Yogo | F28D 9/0075 165/166 |
| 4,815,534 | A * | 3/1989 | Fuerschbach | F28D 9/0075 165/166 |
| 5,287,918 | A * | 2/1994 | Banks | B21D 53/045 165/165 |
| 6,224,334 | B1 * | 5/2001 | Siga | C21D 9/38 415/101 |
| 7,219,720 | B2 * | 5/2007 | Wakita | B23P 15/26 165/153 |
| 2002/0071797 | A1 * | 6/2002 | Loffler | B01J 37/0248 422/600 |
| 2007/0261821 | A1 * | 11/2007 | Richter | B21C 37/158 165/104.19 |
| 2008/0236802 | A1 * | 10/2008 | Koepke | F28D 9/005 165/167 |
| 2012/0234523 | A1 * | 9/2012 | Jouanny | F28D 9/005 165/166 |
| 2013/0153072 | A1 | 6/2013 | Vreeland et al. | |
| 2014/0060789 | A1 | 3/2014 | Rousseau | |

FOREIGN PATENT DOCUMENTS

| | | | | |
|---|---|---|---|---|
| EP | 2927631 | A1 | 10/2015 | |
| JP | S57-187594 | A | 11/1982 | |
| WO | 2014/125566 | A1 | 8/2014 | |
| WO | WO 2014125566 | A1 * | 8/2014 | F28F 3/06 |

OTHER PUBLICATIONS

Written Opinion of the International Searching Authority issued in PCT/EP2015/071264, dated Nov. 19, 2015 (5 pages).

* cited by examiner

HEAT EXCHANGER, IN PARTICULAR A CONDENSER

OBJECT OF APPLICATION

The object of the present application is a heat exchanger, particularly a condenser, for use inter alfa in automobile air conditioning systems.

BACKGROUND

Known solutions referred to the subject of the application relate to plate heat exchangers. Such heat exchangers are formed by a packet consisting of suitably shaped thin plates forming the heat exchange surface. The, plates are usually extruded to form a pattern of bulges and recesses on their surface. Forming a stack, or otherwise a packet, of plates and their tight connection, for example by welding, soldering or screwing between outer protection panels, forms the channel systems between the plates. The plates are also provided with openings in appropriate positions, which, after sealing and forming a packet of plates, form inlet and outlet channels for the media participating in heat transfer.

The essence of the plate heat exchangers is that the flow Pathways of media are interleaved, i.e. the consecutive spaces between the plates are alternatively used for heat-emitting medium and heat-receiving medium. In addition, channel systems formed by the extrusions of adjacent plates, cause the breakdown of the stream of each medium on many smaller streams and the introduction of the turbulence in the flow stream, resulting in better heat transfer between the media.

Said plate heat exchangers can have various applications, among others, they can serve as evaporators, condensers and liquid-liquid heat, exchangers.

An example of the heat exchanger is the Valeo condenser based on the technology used in the construction of the oil coolers by a liquid. Said design uses overpresses in heat exchanger plates, so-called corrugations, the appearance of which resembles a fish bone. Thus, the two circuits, the refrigerant circuit and coolant circuit, are interleaved each other extending alternatively through consecutive spaces between the internal plates. It should be noted that this solution provides for the use of the same overpresses both for one and second circuit, which limits the range of media, being the heat exchange media for which the heat transfer will be sufficiently effective, to a liquid. In other words, the same shape of the turbulator plates in both circuits of the heat exchanger provides an efficient reduction of the flow velocity and introduction turbulence in the flow only for the heat transfer agents, the substances of which have similar physical properties.

An example of a heat exchanger serving as a condenser of gaseous refrigerant in the automotive air conditioning system is the solution described in U.S. Patent Application No. 2013/0153072 to Delphi Technologies, Inc. Said solution comprises two end plates defining there between a slot for housing a turbulator panel. The turbulator panel serves at the same time for reinforcing of the structure between the end plates, as well as it is an obstacle to the flow of the refrigerant and causes a decrease in the flow rate and its interfering resulting is releasing of the liquid phase, which is collected at the bottom part of the condenser or discharged to the outside, depending on the arrangement of inlet and outlet channels. The construction of such condenser provides the placement of a larger number of turbulator panels separated with internal plates, which lengthens the flow path of the refrigerant in the heat exchanger and provides to obtain suitable conditions for condensation.

This solution also provides for cooperation with the additional coolant circuit, however the shape of the coolant circuit, as well as turbulator panels used therein, was not precisely specified.

It should be noted that in the case of a heat exchanger in which the heat emitting refrigerant is a gas changing its physical state to a liquid as a result of the cooling, while the heat-receiving coolant is a liquid, the important matter is suitable flow control separately for each of these media, i.e. to reduce the flow speed, to introduce respective turbulences in a flow stream and its suitable dividing while maintaining low pressure drop of the flowing medium. Due to the different physical properties of the media participating in heat exchange, it is necessary to form their flow paths through a heat exchanger in different ways so as to obtain the most efficient heat exchange there between.

The above-described solution of heat exchangers comprising a packet of pressed metal sheets is not favourable to an independent shaping of the channel system for the gaseous medium and liquid medium due to the fact that the extrusion of a metal sheet influences simultaneously both on a shape of its surface which forms a channel system for the gaseous refrigerant as well as on the surface interacting with a liquid coolant. Therefore, in such system it is not possible any influence on the shape of the flow path of one medium independently of the shape of the second refrigerant flow path.

The above problem is also not resolved by the structure disclosed in the aforementioned U.S. Patent Application No. 2013/0153072, which is referred to the condensation of the refrigerant as a result of its precipitation on the obstacle in the form of a turbulator panel, because its essential solution shows only the refrigerant, circuit, while the suggested possibility of introducing the coolant circuit was not clarified with respect to its shape.

Therefore, an object of the present invention is to provide solution of a heat exchanger, which uses independent and a different configuration of the gaseous refrigerant and liquid coolant flow paths, according to the different physical properties each of the media being said refrigerant and coolant, which allows optimal reduction of the flow rate of each of them and introduction of the flow disturbances while maintaining low pressure drop, resulting in greatly increased efficiency of heat exchange between them.

The present invention aims also to provide a solution that can be easily configured depending on the predefined conditions of use, i.e. the type of gaseous and liquid media that will participate in the heat exchange.

The present invention aims also to provide a solution that will implement the function of a water-cooled condenser for the gaseous refrigerant.

SUMMARY OF THE INVENTION

Heat'exchanger, in particular condenser, comprising two parallel end closing plates (1, 2) having a coolant inlet and outlet and at least one inlet and an outlet of the refrigerant, the heat exchange unit arranged between the closing plates and including at least one coolant compartment and at least one refrigerant compartment, separated by an inner plate, wherein the coolant compartments and refrigerant compartments are arranged alternately and connected such that they form together with said inlets and outlets separated hydraulic circuits for the coolant and the refrigerant, and a turbulator panel arranged in each of the compartments, is characterized in that the turbulator panels of the refrigerant circuit comprise on their surface first disturbing elements, the shape of which is matched to the physical properties of the gaseous refrigerant, and which determine the height of the turbulator panel of the refrigerant circuit, wherein the turbulator panels of the coolant circuit comprise on their surface second disturbing elements, the shape of which is matched to the physical properties of the liquid coolant, and which determine the height of the turbulator panel of the coolant circuit, wherein the shape of the first disturbing elements is different from the shape of the second disturbing elements, whereas the shape of the turbulator panels is matched to the independent optimal managing, slowing down and disturbing of the refrigerant and the coolant, while ensuring a low pressure drop of their flow to achieve a high heat exchange coefficient.

Preferably, the first disturbing elements have a wavy shape with a rounded or rectangular contour, wherein they are oriented so that a refrigerant flow passes along the waves.

Preferably, the second disturbing elements are triangular or rectangular contoured projections which are cut and extruded in the turbulator panel and arranged in rows along the cutting lines, wherein they are oriented so that the coolant flow passes along the cutting lines.

Preferably, the triangular contoured projections extend alternately in opposite directions with respect to a surface of the turbulator panel, wherein the tip of each projection is flattened and arched outward for better contact with the surface of the inner plate and the closing plate, and furthermore a flat transition surface is arranged between adjacent projections in a row.

Preferably, the rectangular contoured projections extend in one direction relative to the surface of the turbulator panel and furthermore adjacent rows of projections are offset relative to one another at some distance, parallel to the cutting line.

Preferably, the height of the turbulator panel of the coolant circuit is from 1 to 1.5 times greater than the height of the turbulator panel of the refrigerant circuit.

Preferably, the refrigerant circuit comprises a condensing area and a sub-cooling area, wherein said areas are separated from the space between the inner plates and between the inner plates and the closing plates and separated from each other and furthermore each turbulator panel of the refrigerant circuit comprises a first part located in the condensing area and a second part located in the sub-cooling area.

SHORT DESCRIPTION OF THE DRAWINGS

Figure 2:
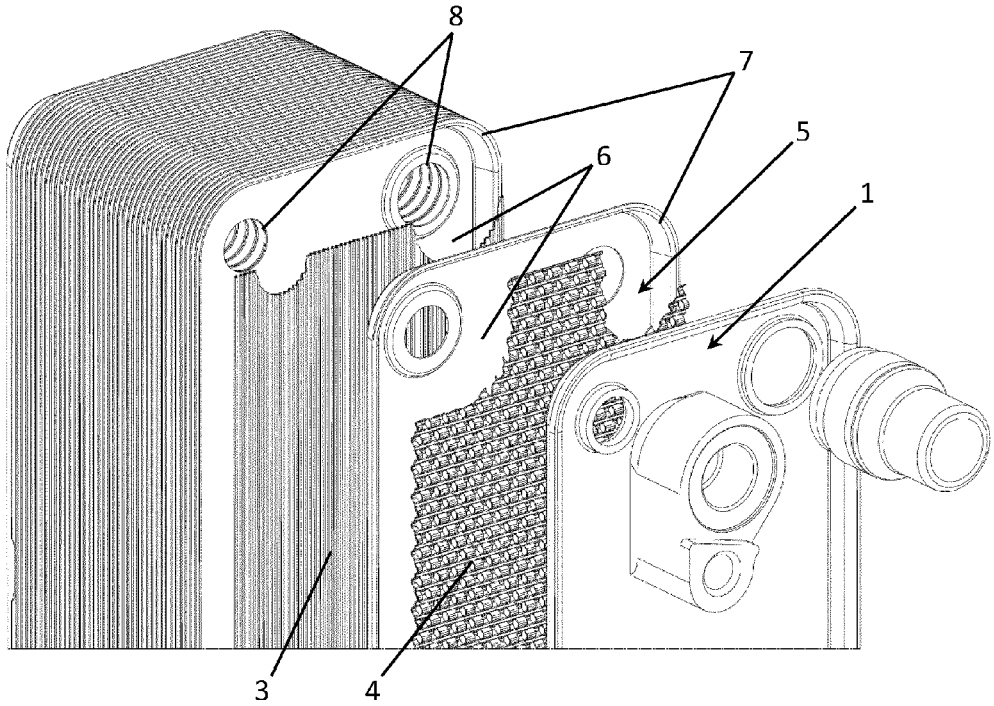
Figure 3:
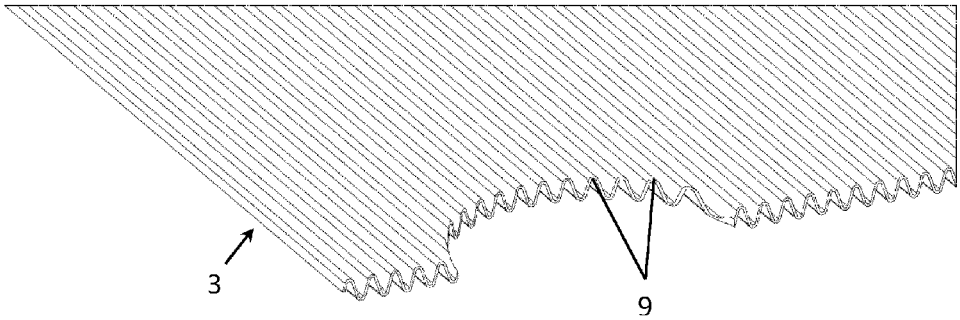
Figure 4:
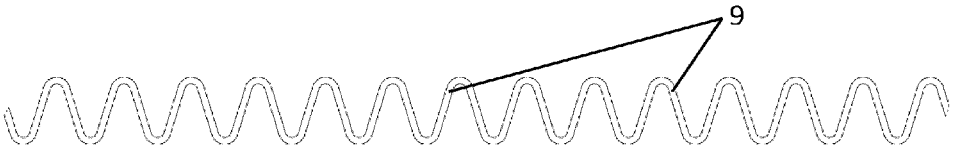
Figure 5:
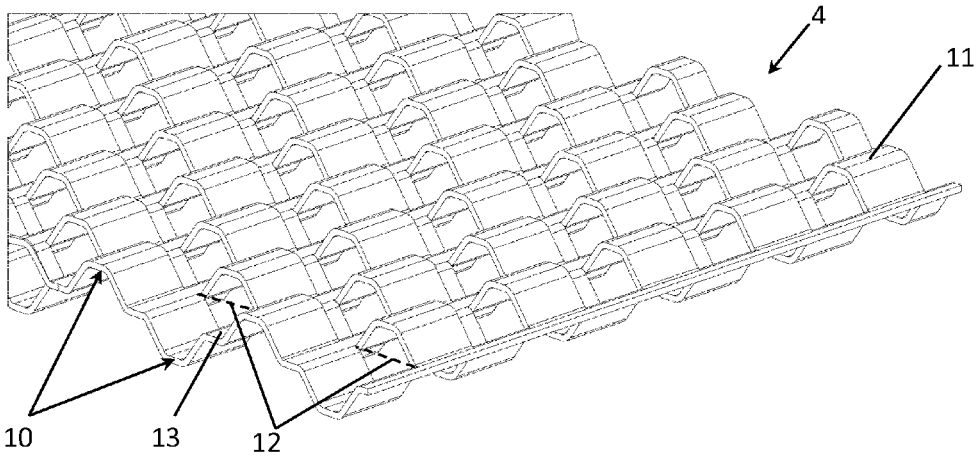
Figure 6:
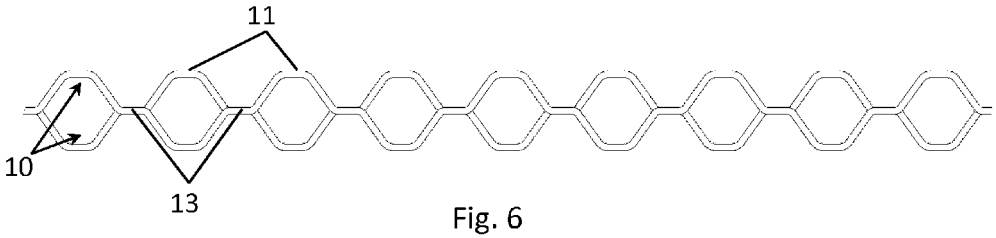
Figure 7:
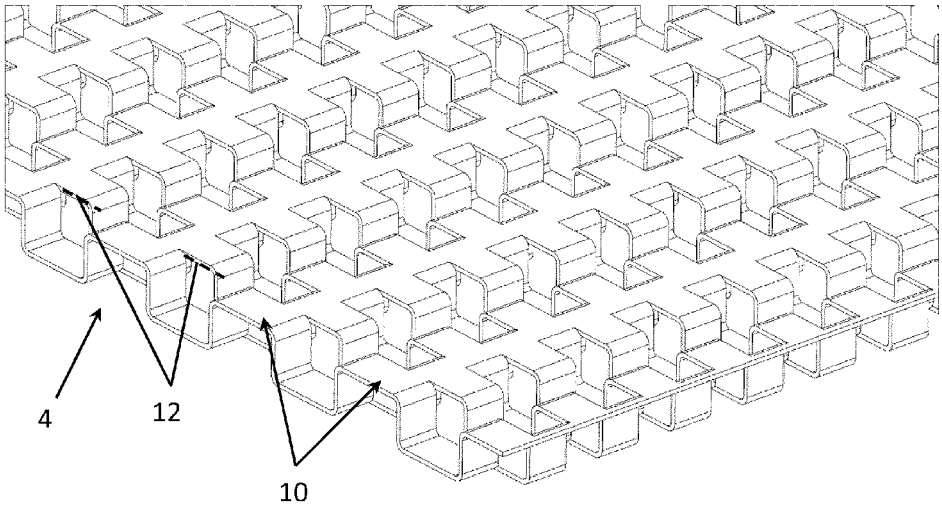
Figure 8:
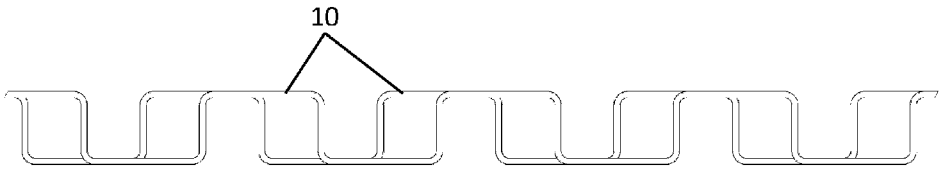
Figure 9:
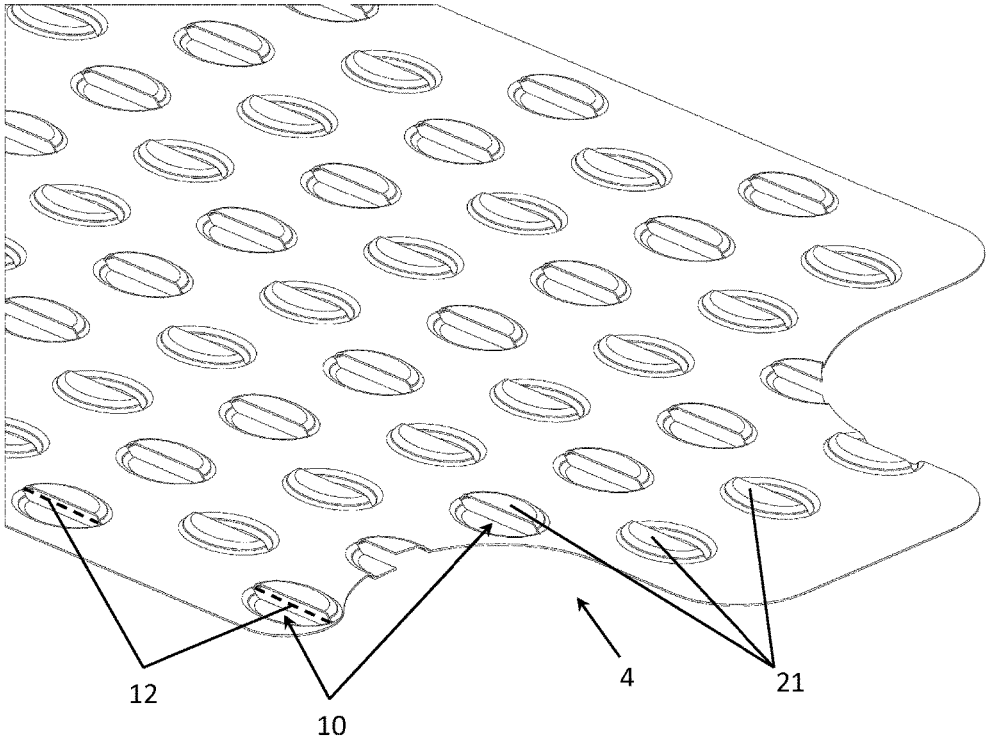
Figure 10:
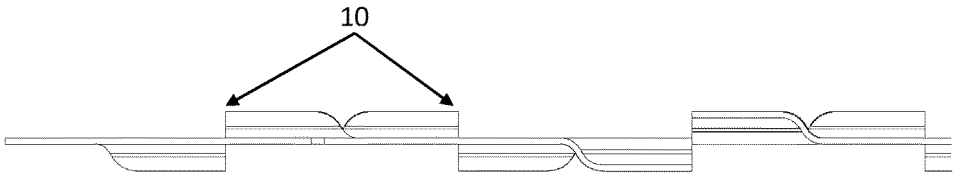
Figure 11:
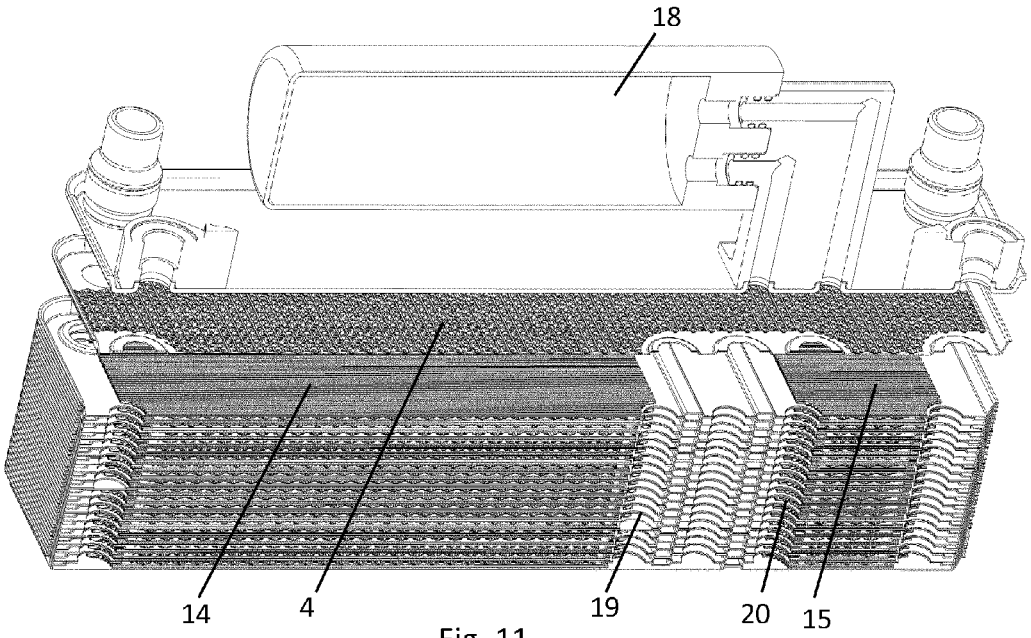
Figure 12:
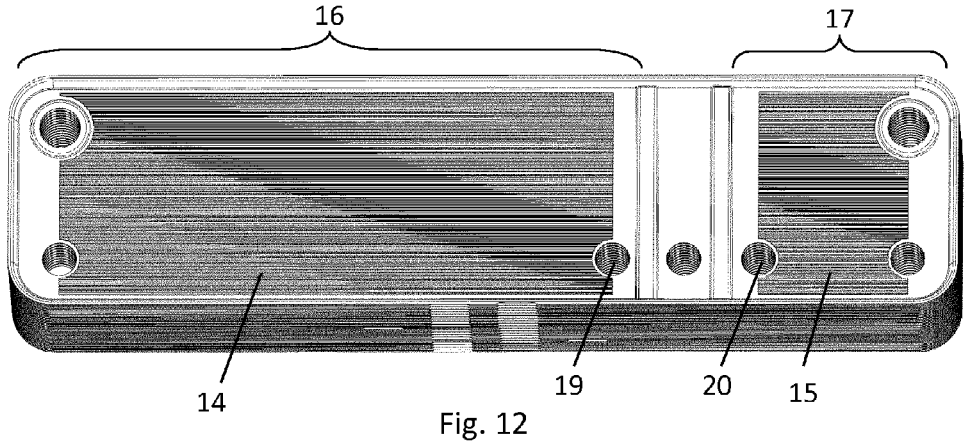

The object of the invention is shown in the embodiments in the drawing, in which FIG. 1 shows a perspective exploded view of a heat exchanger according to a first embodiment of the invention, FIG. 2 shows a perspective enlarged exploded view of a heat exchanger according to a first embodiment of the invention, FIG. 3—a perspective view of the turbulator panel of the refrigerant circuit, FIG. 4—a front view of the turbulator panel of the refrigerant circuit, FIG. 5—a perspective view of a first variation of the turbulator panel of the coolant circuit, FIG. 6—a side view of a first variation of the turbulator panel of the coolant circuit, FIG. 7—a perspective view of the second variation of the turbulator panel of the coolant circuit, FIG. 8—a side view of a second variation of the turbulator panel of the coolant circuit, FIG. 9—a perspective view of the third embodiment of the turbulator panel of the coolant circuit, FIG. 10—a side view of the third variant of the turbulator panel of the coolant circuit, FIG. 11—a perspective partial exploded view of the heat exchanger according to a second embodiment of the invention, a FIG. 12—a view of a compartment of the refrigerant circuit of the heat exchanger according to a second embodiment of the invention.

DESCRIPTION OF EMBODIMENTS

FIG. 1 shows an example of a heat exchanger which is a condenser for the gaseous refrigerant, generally R134a or R1234YF, in which is also formed the circuit for the liquid coolant, usually water, glycol or combinations thereof, participating in the heat exchange with the refrigerant and supporting its condensation process. The presented solution is intended for use in an air conditioning system located in the vehicle.

As illustrated in FIG. 2, the condenser comprises an upper 1 and lower 2 closing plates, wherein the lower closing plate 2 is free of openings, while the upper closing plate 1 is provided with inlet and outlet openings of the refrigerant and coolant, to which stub pipes intended for connection to an air-conditioning system are fixed.

A number of turbulator panels 3, 4 is arranged in parallel between the upper and lower closing plates, wherein they are two differently shaped types of turbulator panels arranged alternately and separated by the inner plates 5. The closing plates 1, 2 and the inner plates 5 have a flat central portion 6 and the flange 7 surrounding thereof, which abuts on the edge to the flanges of adjacent internal plates 5 or closing plates 1, 2, as a result of which the separated, enclosed spaces are formed between the plates, in which the turbulator panels 3, 4 are arranged. In the central parts 6 of the upper closing plate 1 and the internal plates 5 the apertures B are formed for supplying and receiving of the refrigerant and coolant. Said apertures 8 are tightly connected in the proper configuration, usually by means of the surrounding overpresses and soldering, forming, together with the spaces containing turbulator panels, circuits for each of the heat exchanging media. The connections of the apertures 8 are formed so that the adjacent spaces between the plates belong to different circuits, thereupon the refrigerant and coolant circuits are interleaved each other. Furthermore, said apertures 8 are arranged and connected so that in the area of one space, the flow of the refrigerant or coolant flowing between the supplying aperture in one plate and the discharging aperture in the adjacent plate fills the entire volume of the space between the plates and is directed through the turbulator panel 3, 4.

Each of the turbulator panels 3, 4 fills the entire space along the central portions 6 of the inner and closing plates 1, 2, between the flanges 7 and between adjacent inner plates 5 or between the inner plate 5 and one of the closing plates 1, 2, except areas above the apertures B in the upper closing plate 1 and the internal plates 5, and in the case of turbulator panel 3 of the refrigerant circuit, also the areas at the ends of the inner and outer plates, close to the supplying and discharging openings. Each of the turbulator panels 3, 4 is a thin metal sheet made of aluminium or its alloys, of a thickness in the range from 0.1 to 0.4 mm, which is formed by extrusion and/or cutting such that it forms the spatial structure which respectively separates the flow of the heat exchange medium flowing into the space between the plates, causing a reduction of the flow rate and introducing the turbulence into the flow, which influences the efficiency of a heat exchange transferred between the refrigerant and the coolant via the internal plates 5. Further, turbulator panels 3, 4 are in contact with the surfaces of the central portions 6 of the adjacent inner plates 5 and closing plates 1, 2 and they are soldered to them, so that the height of the turbulator panels 3, 4, corresponding to the distance between adjacent inner plates 5 and closing plates 1, 2, is from 1.5 to 3 mm.

Each turbulator panel 3 of the gaseous refrigerant circuit, shown in FIGS. 3 and 4, has embossed first wave shaped disturbing elements 9 forming wave-shaped surface, wherein the height of waves determines the height of the turbulator panel 3, which corresponds to the width of the compartment formed between adjacent internal plates 5 or between the inner plate 5 and the closing plate 1, 2. The S shape of the first disturbing elements 9 is adapted to the physical characteristics of the gas used as a refrigerant, wherein the waves may have either rounded as well as rectangular shape. Sizes of the first disturbing elements 9 depends on the hydraulic diameter required for obtaining of the proper flow rate of the refrigerant, and thus the optimum heat transfer coefficient of the refrigerant gas.

However, each of the turbulator panels 4 of the coolant circuit shown in FIGS. 5 and 6, comprises second disturbing elements 10 having shape different than the first disturbing elements 9 adapted to the physico-chemical properties of the coolant, in this case water with a glycol. The second disturbing elements 10 are made by notching of the plate of the turbulator panel 4, and embossing of the triangular projections protruded alternately on both sides, up and down relative to the surface of the turbulator panel 4, wherein said projections have flat tops 11 which are rounded on the outside, which improves the contact between the turbulator panel 4 and the inner plates 5 or the closing plates 1, 2 and increases the executing efficiency of the soldered joint with surfaces of the adjacent inner plates 5 or the closing plates 1, 2.

The design of the turbulator panel 4 of the coolant circuit, shown in FIGS. 5 and 6, is formed from the metal sheet having a thickness of 0.16 mm and it has a height of 2 mm, which is twice the height of the second disturbing element 10. The second disturbing elements 10 form rows extending along the cutting line 12. The width of said rows, which is also the width of the second disturbing elements 10, is from 1 to 3 mm, and preferably 2 mm. A pitch between adjacent second disturbing elements 10 in the row is from 1.5 mm to 4 mm, and preferably 2.75 mm. In addition, adjacent second disturbing elements 10 in each row are separated by flat areas 13, the length of which depends on the pitch value and is in the range of 0.2 to 0.8 mm, and preferably 0.5 mm. The same relationship is with respect to the length of the flattened tops 11 of the second disturbing elements 10, which is in the range from 0.2 mm to 0.6 mm and preferably it is 0.4 mm.

The shape of the second disturbing elements 10 is not limited to that described above. They can also create rows of the rectangular projections extending in one direction relative to the surface of the turbulator panel 4, as shown in FIGS. 7 and 8. In the illustrated embodiment, said projections have a height of 2 mm, which is also the height of the turbulator panel 4. The width of each row of the projections is 1.5 mm, while the length of each projection in a direction parallel to the cutting line is 3.45 mm. The distance between projections in a row is 3.55 mm. Adjacent rows of rectangular projections are offset relative to one another parallel to the cutting line 12.

FIGS. 9 and 10 shows an example of "bubble" type second disturbing elements 10. In this example, the second disturbing elements 10 are projections having the shape of truncated cone having an ellipse shaped base. Each of the mentioned projections is divided by the cutting line 12 which in this example coincides the major axis of the ellipse, into two parts, wherein one of the mentioned parts of the disturbing element 10 extends beyond the plane of the turbulator panel 4 in one direction while the second part of the disturbing element 10 extends beyond the plane of the turbulator panel 4 in the direction opposite to the first part. Second disturbing elements 4 are arranged in rows extending in parallel to the cutting lines 12, wherein the adjacent rows are mutually shifted in the direction parallel to the cutting line 12. Therefore, passages for the coolant are formed in the plane of the turbulator panel 4, through which the flow of the coolant is disturbed and guided on both sides of the turbulator panel.

The size=of the major axis of the ellipse being the base of each second disturbing element 10 is from 3 to 10 mm, preferably 6, 4 mm, and the size of the minor axis of the ellipse is from 3 to 7 mm, preferably 4.4 mm. Each part of the disturbing element 10 has also the flat face 21 having the shape of an ellipse half. The face 21 is positioned in a distance from the plane of the turbulator panel 4, parallel to it, and faces outside. The face 21 is configured for connecting with the central portion 6 of the internal plate 5 or the closing plates 1, 2. The size of the major axis of the ellipse of the face 21 is from 3 to 10 mm, preferably 5 mm, while the size of the minor axis of the ellipse is from 2 to 7 mm, preferably 3 mm.

The distance between the adjacent disturbing elements 10 in each row is from 5 to 30 mm, preferably 18 mm, and the distance between the adjacent rows is from 5 to 15 mm, preferably 7, 8 mm. The height of the turbulator panel 4 in this example, being the sum of the heights of two parts of the disturbing element 10, is from 1 to 2 mm, preferably 1,5 mm.

Said configuration of the second disturbing elements 10 of the turbulator panels of the coolant circuit is adapted to the flow managing of the medium in a liquid state and increases efficiency of the receiving of the heat emitted by the refrigerant while optimizing the pressure drops in the flow stream.

It should be noted that the direction of the refrigerant flow is substantially rectilinear and follows along the wave crests of the turbulator panel 3, while the flow direction of the coolant is parallel to the direction of the cutting line 12 in the turbulator panel 4 such that the coolant impinges on the side walls of the second disturbing elements 10, and its flow paths is subject to rapid changes (see FIGS. 1 and 2).

In the illustrated embodiment, the height of the turbulator panels 3, 4, both of the refrigerant and the coolant circuit is the same, which simplifies the fabrication process of the heat exchanger, since the height of the flanges 7 of the closing plates 1, 2 and the inner plates 5 can be the same. However, the height of the turbulator panels 4 of the coolant circuit can be greater than the height of the turbulator panels 3 of the refrigerant circuit. Preferably, the height of the turbulator panels 4 of the coolant circuit is from 1 to 2 of the height of the turbulator panels 3 of the refrigerant circuit. Such a system is used in the event that for ensuring optimal heat exchange it is necessary to provide a larger volume of coolant flowing in the time unit, and to optimize the pressure drops. Said event occurs when the R134a/1234YF refrigerant is used, while the water is used as coolant, wherein as is known, the passage of the refrigerant circuit for such air conditioning system needs smaller hydraulic diameter than the passage of the coolant circuit.

Another example of the heat exchanger according to the invention shown in FIGS. 9 and 10, refers to the first embodiment, wherein the turbulator panels 3 of the refrigerant circuit consists of two parts, the first part 14 which is located in the condensing area 16 and the second part 15 located in the sub-cooling area 17 of the heat exchanger. Both parts 14, 15 of each turbulator panel 3 of the refrigerant circuit have the same shape and orientation of the second disturbing elements 10.

Said solution uses a process of forced sub-cooling. The refrigerant flowing into the condensing area 16 is cooled to its phase transition point, then flows into the dehumidifier 18, which is designed to filter the refrigerant and to absorb water, and then it flows into the sub-cooling area 17 for sub-cooling the refrigerant below the phase transition point. A similar structure has been disclosed by the Applicant in European Patent Application No. EP 14461522.6.

The condensing and sub-cooling areas 16, 17 are formed through, separation of the refrigerant circuit between plates of the heat exchanger and hydraulic separation of the separated parts, for example by introducing extrusions in the panels, the height of which is equal to the space between the plates, extending so that the separated heat exchanger being the sub-cooling area 17 is formed, which is operating on the same principle as the heat exchanger described in the previous examples. Each of the condensing area 16h and the sub-cooling area 17 has separate inlet and outlet channels for the coolant, wherein the discharge channel 19 of the condensing area 16 is connected to the supplying channel 20 of the sub cooling area 17 via the dehumidifier 18. Thus, two integrated heat exchangers are formed within a single heat exchanger, the first of which is the condensing area 16, and the second is the sub-cooling area 17, while the coolant circuit is common to both heat exchangers and extends over the entire width of the condenser.

The invention claimed:

1. A heat exchanger, comprising:

two parallel end closure plates forming a coolant inlet and outlet and at least one inlet and an outlet of a refrigerant;

a heat exchange unit arranged between the closure plates comprising at least one coolant compartment and at least one refrigerant compartment, separated by an inner plate, wherein the at least one coolant compartment and the at least one refrigerant compartment are arranged alternately and connected to form, together with said inlets and outlets, separate hydraulic circuits for a coolant and a refrigerant, wherein in each of the coolant and refrigerant compartments a turbulator panel is arranged, wherein the turbulator panels of the refrigerant circuit comprise on their surface, first disturbing elements which determine a height of the turbulator panel of the refrigerant circuit, wherein the turbulator panel of the coolant hydraulic circuit comprise, on at least one-surface, second disturbing elements which determine a height of the turbulator panel of the coolant hydraulic circuit, wherein a shape of the first disturbing elements is different from a shape of the second disturbing elements, wherein the second disturbing elements are cut and/or embossed in the turbulator panel and arranged in rows along cutting lines, wherein the second disturbing elements are oriented so that the coolant flow passes along the cutting lines, wherein the second disturbing elements are circular-arc projections that are shaped as a truncated cone having an ellipse-shaped base, wherein a cutting line coinciding with the major axis of the ellipse, divides a corresponding circular-arc projection into two parts which extend in the opposite direction in relation to the plane of the turbulator panel.

2. A heat exchanger, comprising:

two parallel end closure plates forming a coolant inlet and outlet and at least one inlet and an outlet of a refrigerant;

a heat exchange unit arranged between the closure plates comprising at least one coolant compartment and at least one refrigerant compartment, separated by an inner plate, wherein the at least one coolant compartment and the at least one refrigerant compartment are arranged alternately and connected to form, together with said inlets and outlets, separate hydraulic circuits for a coolant and a refrigerant, wherein in each of the coolant and refrigerant compartments a turbulator panel is arranged, wherein the turbulator panels of the refrigerant circuit comprise on their surface, first disturbing elements which determine a height of the turbulator panel of the refrigerant circuit, wherein the turbulator panel of the coolant hydraulic circuit comprise, on at least one-surface, second disturbing elements which determine a height of the turbulator panel of the coolant hydraulic circuit, wherein a shape of the first disturbing elements is different from a shape of the second disturbing elements, wherein the refrigerant circuit comprises a condensation area and a sub-cooling area, wherein said condensation and sub-cooling areas are separated from the space between the inner plates themselves, between the inner plates and the closing plates, and are separate from each other, and wherein each turbulator panel of the refrigerant circuit comprises a first part located in the condensation area and a second part located in the sub-cooling area.

3. The heat exchanger according to claim 2, wherein the first and second parts have an identical shape.

4. The heat exchanger according to claim 2, wherein the first and second parts are physically separated from one another.

5. The heat exchanger according to claim 2, wherein the turbulator panel contains one part located in both the condensation area and the sub-cooling area.

6. An air conditioning system for a vehicle comprising:

a heat exchanger comprising:

two parallel end closure plates forming a coolant inlet and outlet and at least one inlet and an outlet of a refrigerant;

a heat exchange unit arranged between the closure plates comprising at least one coolant compartment and at least one refrigerant compartment, separated by an inner plate, wherein the at least one coolant compartment and the at least one refrigerant compartment are arranged alternately and connected to form, together with said inlets and outlets, separate hydraulic circuits for a coolant and a refrigerant, wherein in each of the coolant and refrigerant compartments a turbulator panel is arranged, wherein the turbulator panels of the refrigerant circuit comprise on their surface, first disturbing elements which determine a height of the turbulator panel of the refrigerant circuit, wherein the turbulator panel of the coolant hydraulic circuit comprise, on at least one-surface, second disturbing elements which determine a height of the turbulator panel of the coolant hydraulic circuit, wherein a shape of the first disturbing elements is different from a shape of the second disturbing elements, wherein the second disturbing elements are cut and/or embossed in the turbulator panel and arranged in rows along cutting lines, wherein the second disturbing elements are oriented so that the coolant flow passes along the cutting lines, wherein the second disturbing elements are circular-arc projections that are shaped as a truncated cone having an ellipse-shaped base, wherein a cutting line coinciding with the major axis of the ellipse, divides a corresponding circular-arc projection into two parts which extend in the opposite direction in relation to the plane of the turbulator panel.

* * * * *